US010454222B2

(12) United States Patent
Wu et al.

(10) Patent No.: US 10,454,222 B2
(45) Date of Patent: Oct. 22, 2019

(54) CONNECTOR HAVING GROUNDING BAR CONNECTING TO BOTH SHIELDING SHELL AND GROUNDING LAYERS OF WIRES

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Xiao-Xiang Wu, Kunshan (CN); Wei Zhong, Kunshan (CN); Jian-Kuang Zhu, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/232,335

(22) Filed: Dec. 26, 2018

(65) Prior Publication Data

US 2019/0199039 A1 Jun. 27, 2019

(30) Foreign Application Priority Data

Dec. 27, 2017 (CN) ..... 2017 1 1439841
Dec. 29, 2017 (CN) ..... 2017 1 1473612

(51) Int. Cl.
*H01R 9/05* (2006.01)
*H01R 13/6593* (2011.01)
*H01R 13/6585* (2011.01)

(52) U.S. Cl.
CPC ..... *H01R 13/6593* (2013.01); *H01R 13/6585* (2013.01)

(58) Field of Classification Search
CPC ..... H01R 12/598
(Continued)

(56) References Cited

U.S. PATENT DOCUMENTS 3,513,433 A * 5/1970 Carroll ..... H01R 13/6585 439/579
5,241,135 A * 8/1993 Fetzer ..... H01R 9/0512 174/88 R
(Continued)

FOREIGN PATENT DOCUMENTS

CN 204947245 U 1/2016
CN 205752653 U 11/2016
CN 106410517 A 2/2017

*Primary Examiner* — Neil Abrams
(74) *Attorney, Agent, or Firm* — Wei Te Chung; Ming Chieh Chang

(57) ABSTRACT

An electrical connector includes an insulative housing, a plurality of contacts retained in the housing, a metallic shielding shell, and a cable sub-assembly. The contact includes a front mating section and a rear connecting section. The cable sub-assembly includes a plurality of wires and a grounding unit. The wire includes an inner/transmission conductor, an inner insulator, an outer/grounding conductor/layer, and an outer insulator sequentially coaxially arranged with one another. The connecting sections of the contacts are mechanically and electrically connected to the inner conductors of the corresponding wires. The grounding unit includes a grounding bar mechanically and electrically connected to the grounding layers of the corresponding wires and with forwardly extending legs for connection to the shielding shell. Also included is a central shielding plate with extensions at opposite ends for connection to the grounding bar.

20 Claims, 23 Drawing Sheets

(58) Field of Classification Search
USPC ..... 579/579, 497
See application file for complete search history.

(56) References Cited

U.S. PATENT DOCUMENTS 6,217,372 B1 * 4/2001 Reed ..... H01R 13/6593 439/497
6,273,749 B1 * 8/2001 Yang ..... H01R 9/0515 439/497
6,273,753 B1 * 8/2001 Ko ..... H01R 9/035 439/497
6,338,652 B1 * 1/2002 Ko ..... H01R 9/0515 439/497
6,489,563 B1 * 12/2002 Zhao ..... H01R 9/0524 174/880
6,739,910 B1 * 5/2004 Wu ..... H01R 13/514 439/497
7,040,917 B2 * 5/2006 Yagi ..... H01R 9/0527 439/495
7,192,301 B2 * 3/2007 Kuroda ..... H01R 9/032 439/497
7,354,299 B2 * 4/2008 Yamada ..... H01R 9/0512 439/497
7,402,073 B2 * 7/2008 Yotsutani ..... H01R 13/6585 439/394
7,601,029 B2 * 10/2009 Horiuchi ..... H01R 4/20 439/497
7,637,779 B2 * 12/2009 Nagata ..... H01R 12/598 439/497
8,011,950 B2 * 9/2011 McGrath ..... H01R 12/594 439/497
9,647,395 B2 * 5/2017 Hsu ..... H01R 13/405
9,653,849 B2 * 5/2017 Hsu ..... H01R 13/6585
9,985,358 B2 * 5/2018 Zhu ..... H01R 4/027
10,096,936 B2 * 10/2018 Ju ..... H01R 13/6275
10,103,453 B2 * 10/2018 Pao ..... H01R 4/023
10,122,124 B2 * 11/2018 Daughtry, Jr. ..... H01R 13/405
10,135,197 B2 * 11/2018 Little ..... H01R 12/58
2019/0165507 A1 * 5/2019 Hou ..... H01R 12/775

* cited by examiner

CONNECTOR HAVING GROUNDING BAR CONNECTING TO BOTH SHIELDING SHELL AND GROUNDING LAYERS OF WIRES

BACKGROUND OF THE INVENTION

1. Field of the Invention

The present invention relates generally to an electrical connector, and more particularly to the electrical connector equipped with the grounding bar mechanically and electrically connecting both the grounding layers of the wires and the shielding shell.

2. Description of Related Arts

U.S. Pat. No. 9,653,849 discloses an electrical connector having a grounding bar mechanically and electrically connecting the grounding layers of the wires. U.S. Pat. No. 9,647,395 also discloses the similar structures. Anyhow, the enhanced electrical and mechanical effect is expected to be improved.

An improved electrical connector is desired.

SUMMARY OF THE INVENTION

An object of the present invention is to provide an electrical connector having a grounding bar mechanically and electrically connecting both the grounding layers of the wires and the shielding shell.

To achieve the above-mentioned object, an electrical connector includes an insulative housing, a plurality of contacts retained in the housing, a metallic shielding shell, and a cable sub-assembly. The contact includes a front mating section and a rear connecting section. The cable sub-assembly includes a plurality of wires and a grounding unit. The wire includes an inner/transmission conductor, an inner insulator, an outer/grounding conductor/layer, and an outer insulator sequentially coaxially arranged with one another. The connecting sections of the contacts are mechanically and electrically connected to the inner conductors of the corresponding wires. The grounding unit includes a grounding bar mechanically and electrically connected to the grounding layers of the corresponding wires and further to the shielding shell.

DETAILED DESCRIPTION OF THE PREFERRED EMBODIMENT

Figure 1:
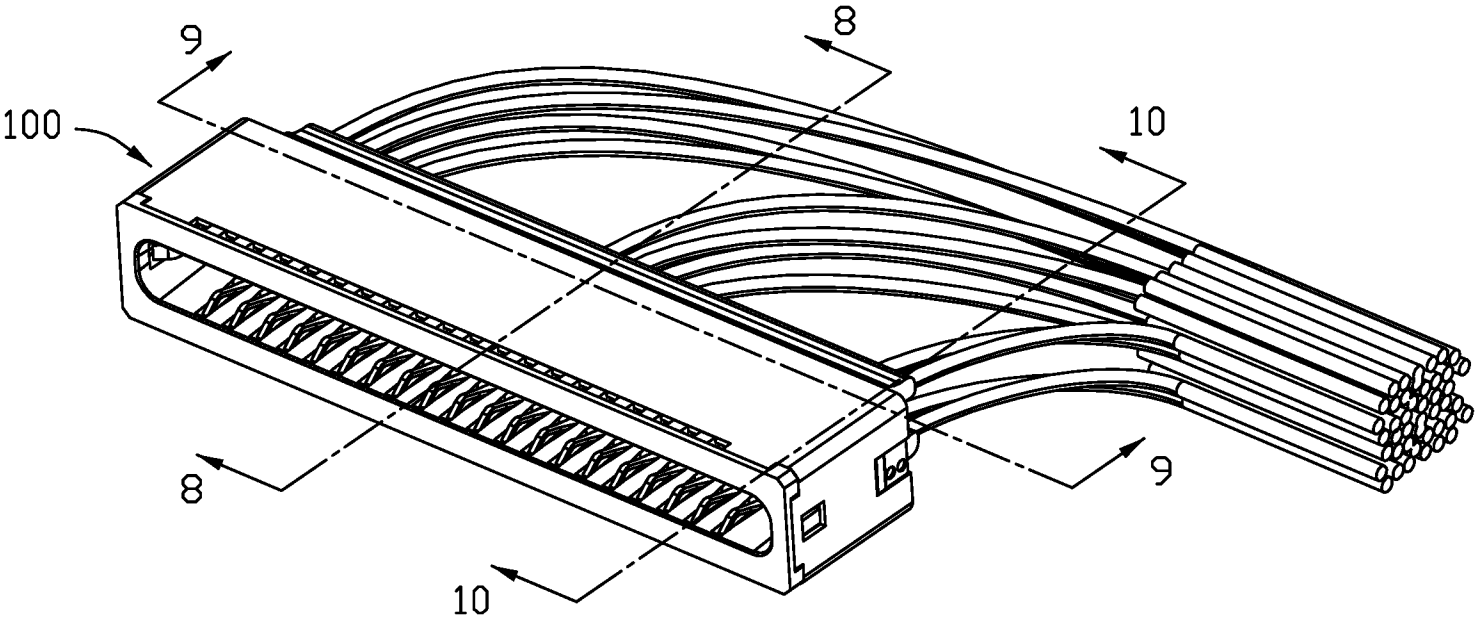
FIG. 1 is a perspective view of an electrical connector according to the first embodiment of the present invention.
Figure 2:
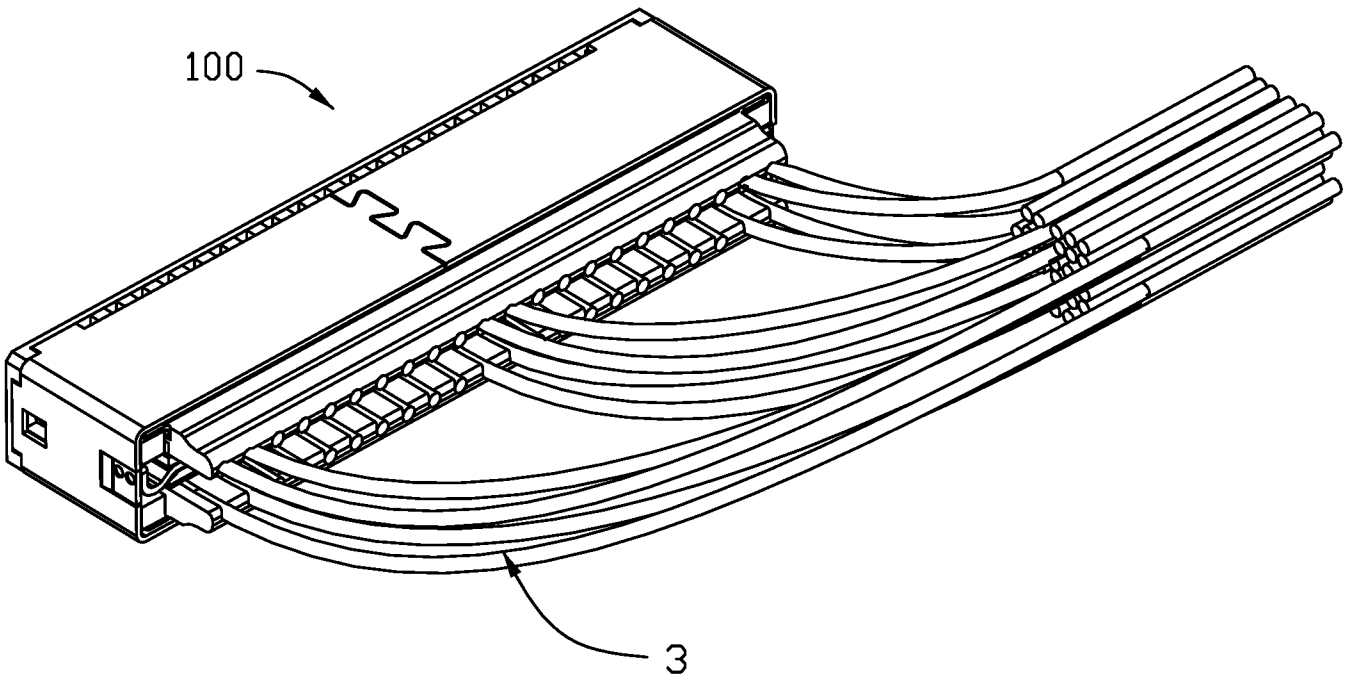
FIG. 2 is another perspective view of the electrical connector of FIG. 1.
Figure 3:
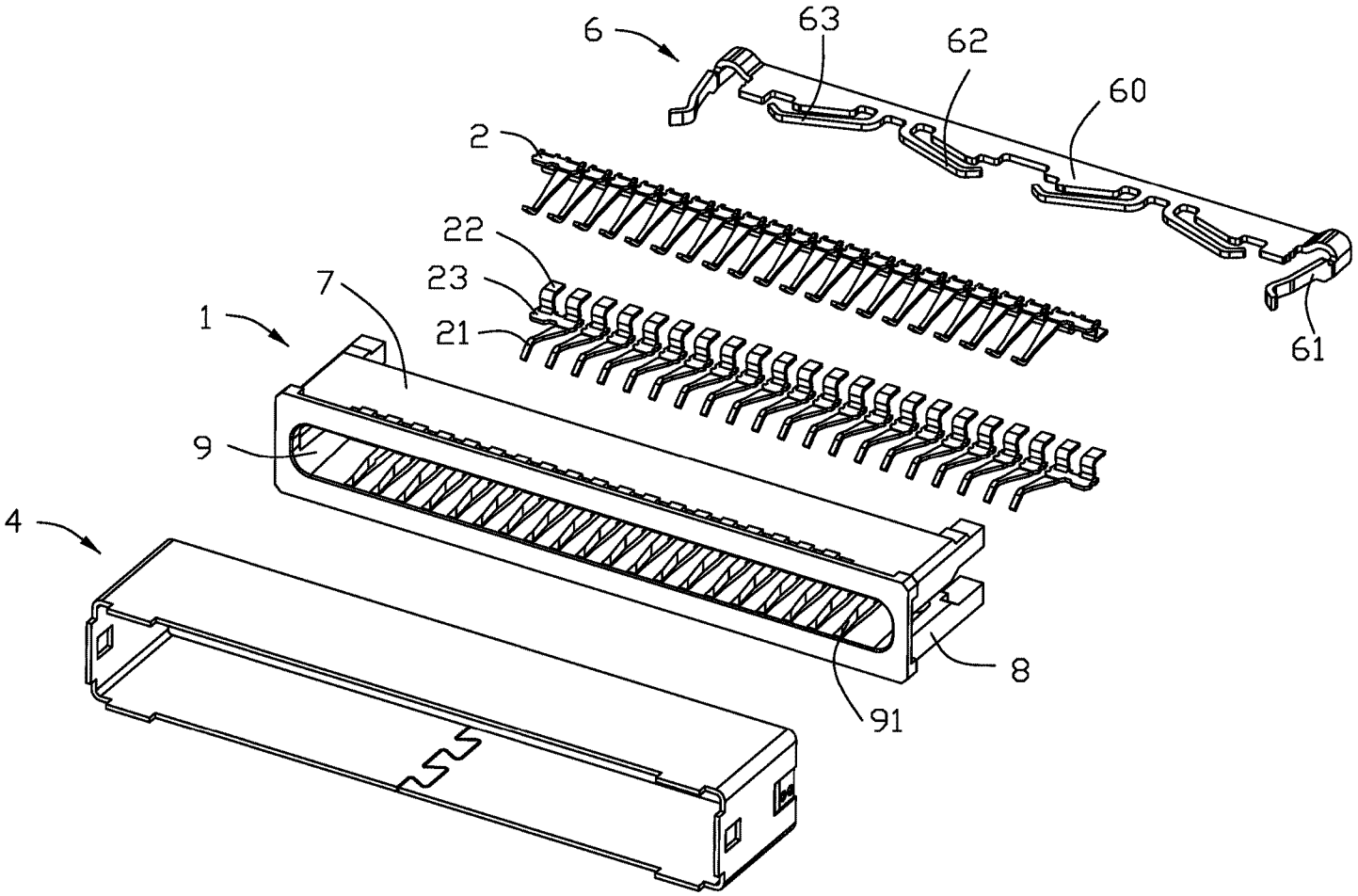
FIG. 3 is an exploded perspective view of the electrical connector of FIG. 1 without showing the cable sub-assembly.
Figure 4:
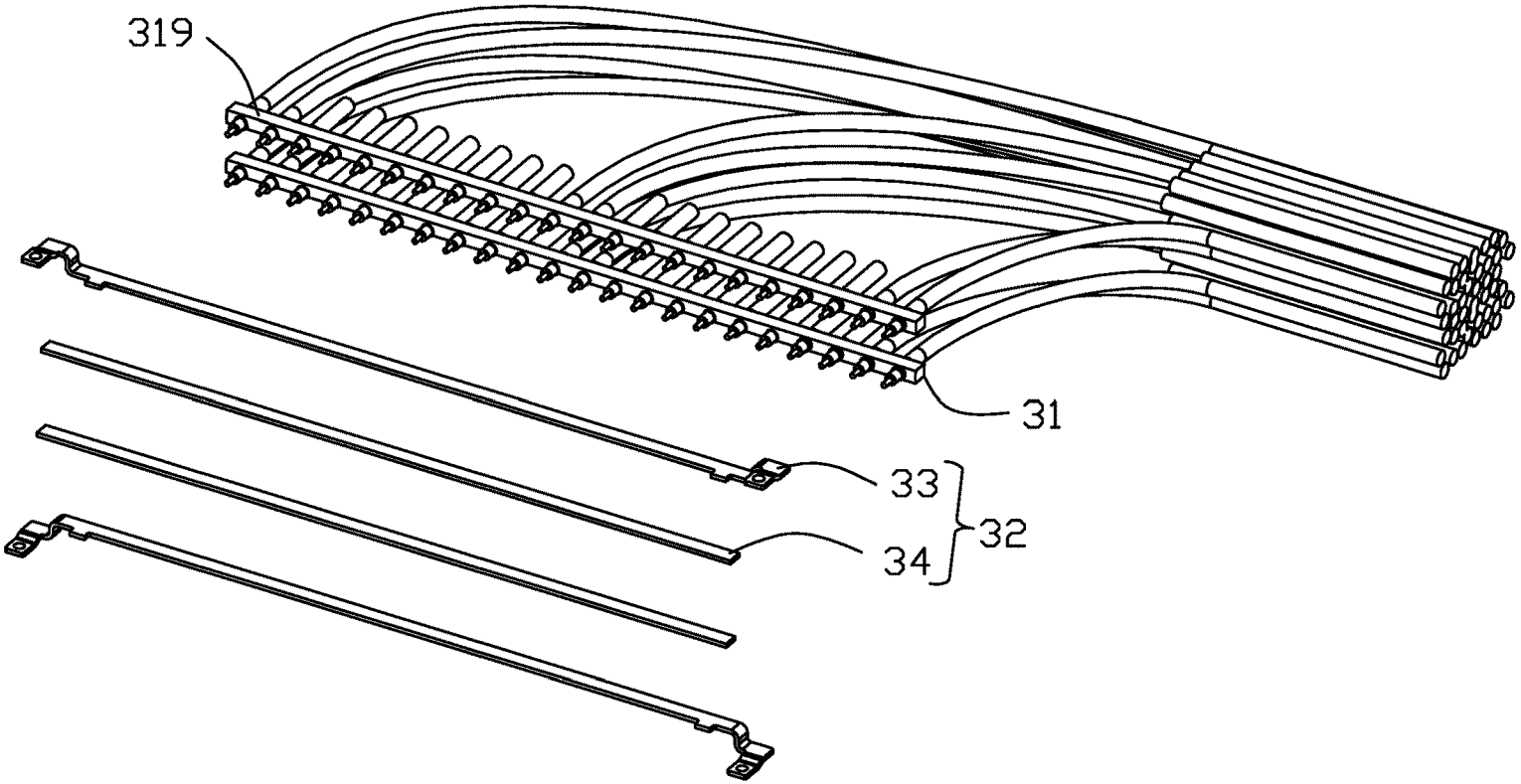
FIG. 4 is a an exploded perspective view of the cable sub-assembly of the electrical connector of FIG. 1.
Figure 5:
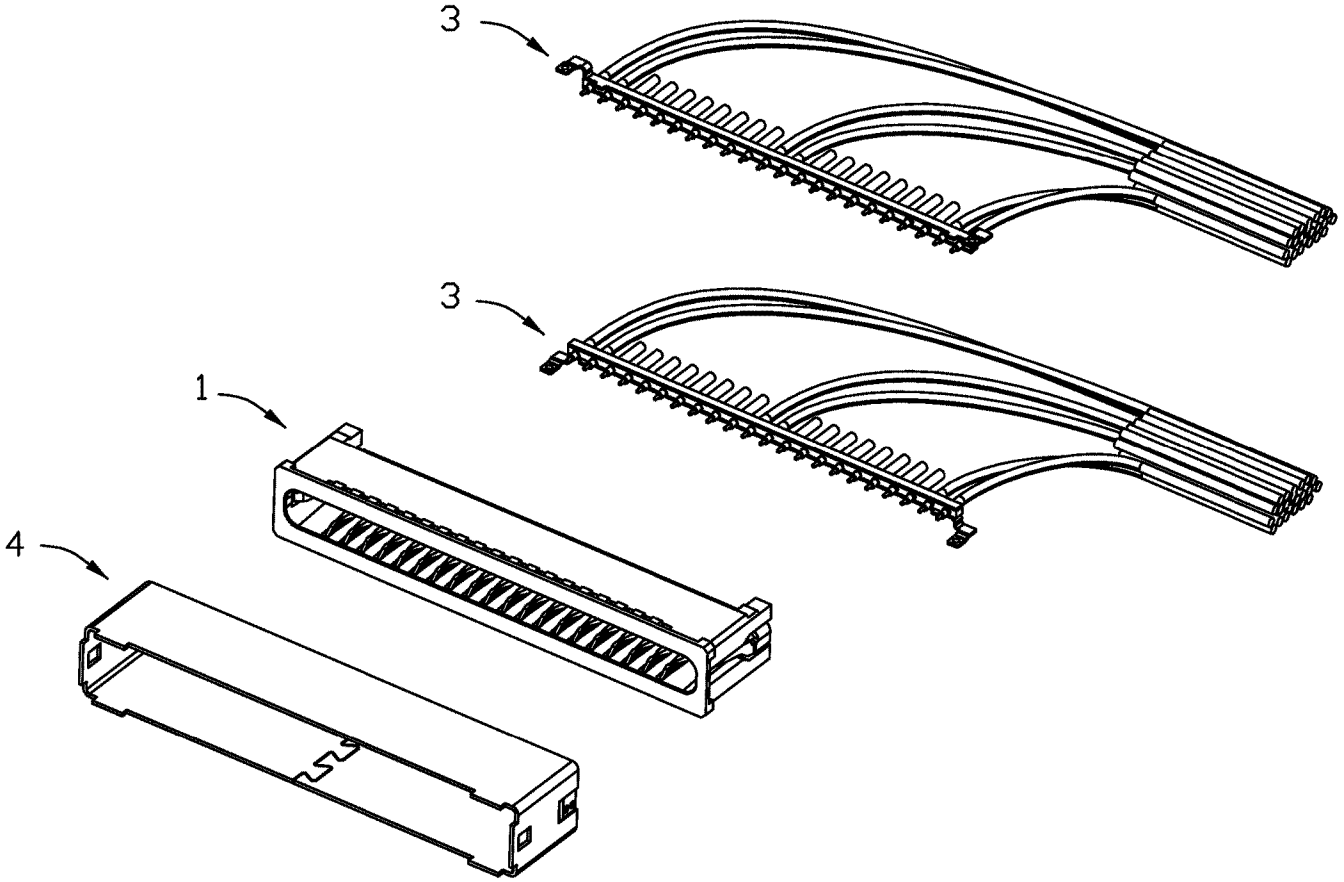
FIG. 5 is an exploded perspective view of the electrical connector of FIG. 1.
Figure 6:
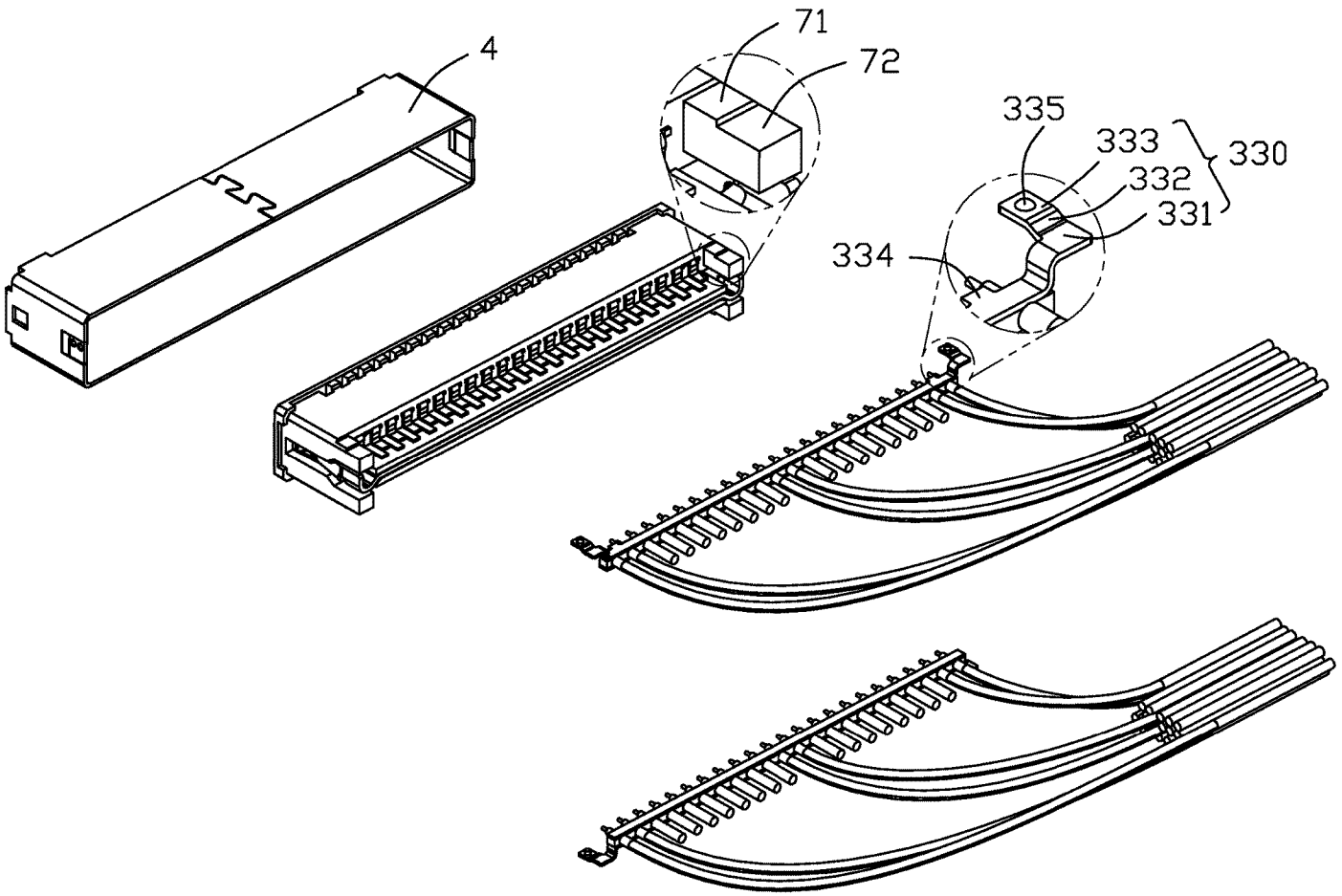
FIG. 6 is another exploded perspective view of the electrical connector of FIG. 1.
Figure 7:
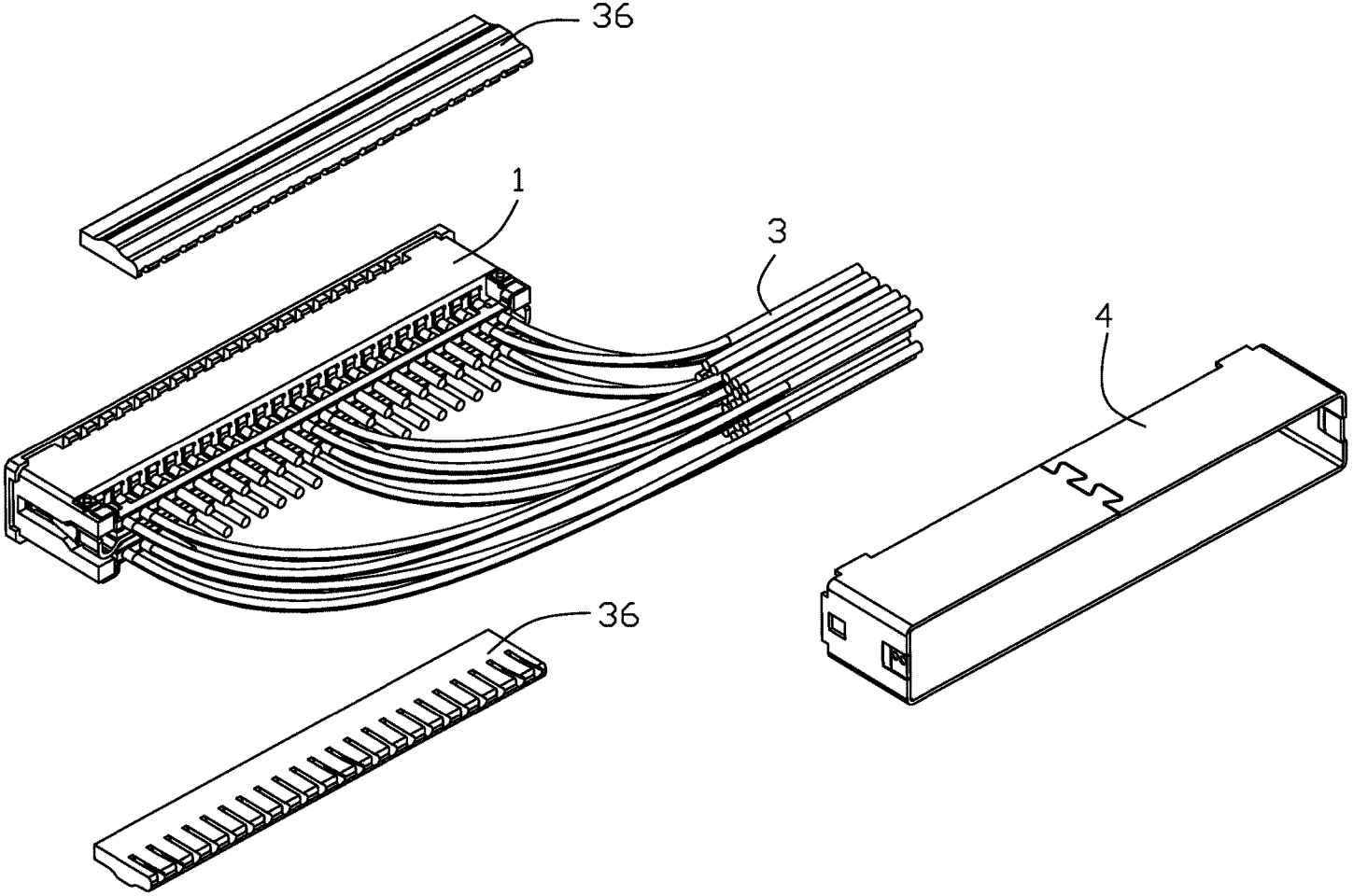
FIG. 7 is another exploded perspective view of the electrical connector of FIG. 1 with the fixing members removed away therefrom.
Figure 8:
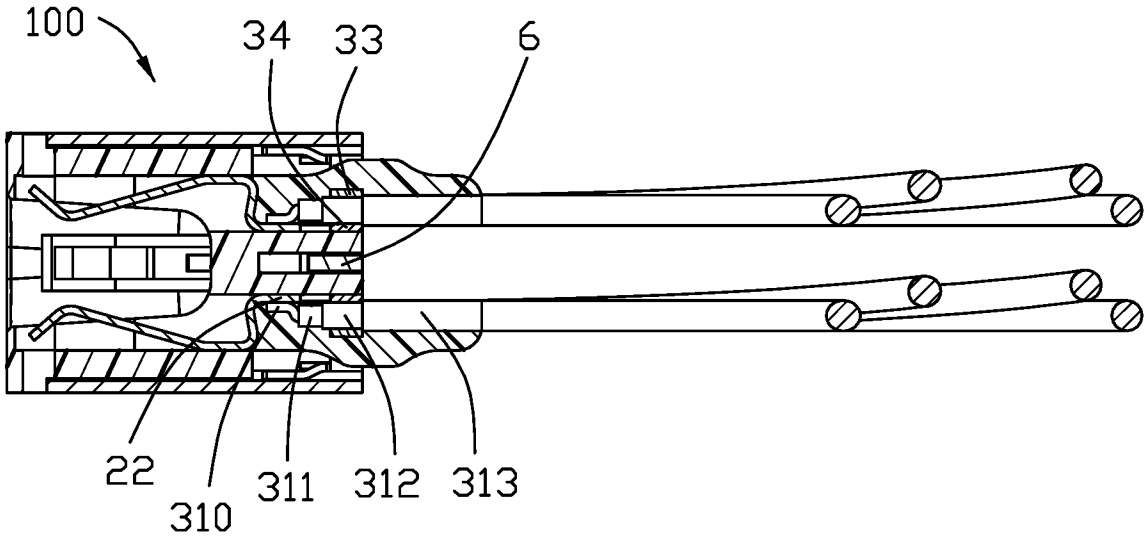
FIG. 8 is a cross-sectional view of the electrical connector of FIG. 1 to show how the fixing member retains the wires and the connecting sections of the contacts.
Figure 9:
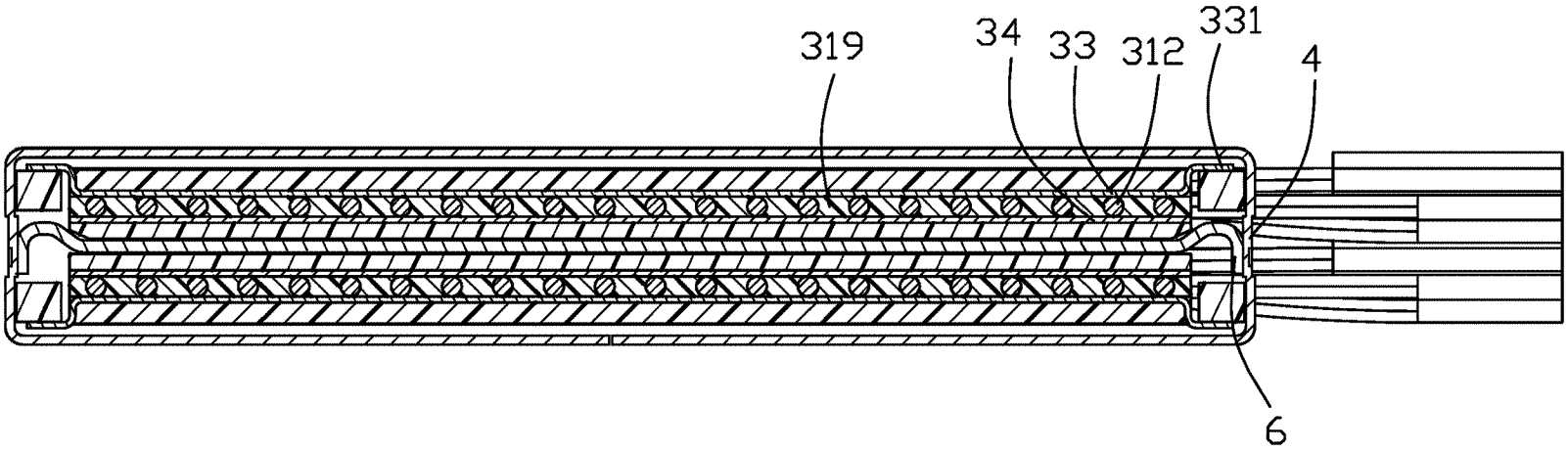
FIG. 9 is another cross-sectional view of the electrical connector of FIG. 1 to show how the shielding plate contacts the shielding shell.
Figure 10:
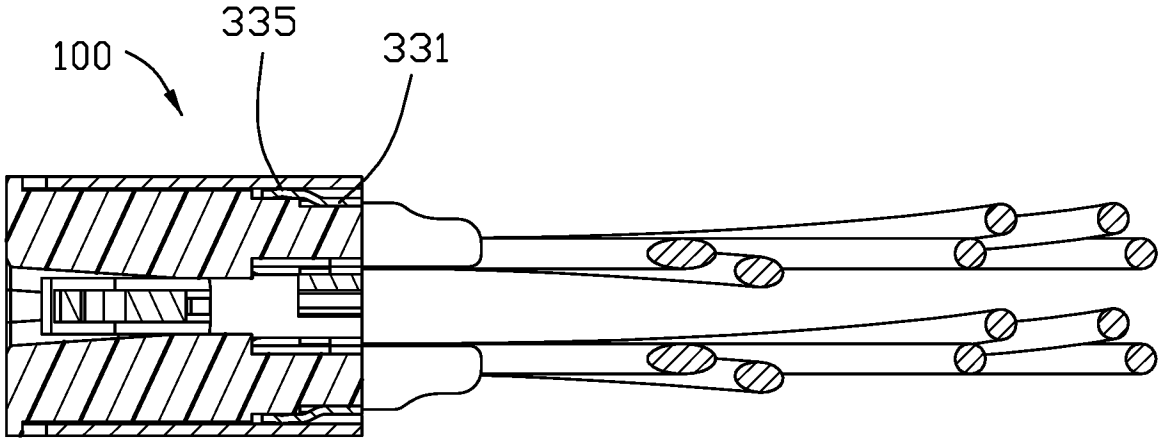
FIG. 10 is another cross-sectional view of the electrical connector of FIG. 1 to show the side spring finger of the shielding plate extending into the mating cavity.

The reference numerals are only referred to the respective embodiments individually. Referring to FIGS. 1 to 10, an electrical connector 100 includes an insulative housing 1, two rows of contacts 2 retained in the housing 1, a metallic shielding shell 4 enclosing the housing 1, and a cable sub-assembly 3. The housing 1 includes two side walls 7 extending along a longitudinal direction and a pair of end walls 8 connected therebetween at two opposite ends so as to form a mating cavity 9. The contact 2 includes a retaining section 23, a contacting section 21 extending forwardly from the retaining section 23, and a connecting/tail section 22 extending rearwardly from the retaining section 23. The cable sub-assembly 3 includes a plurality of wires 31 and a grounding unit 32. The wires 31 are optionally or optimally integrally secured together by an transverse bar 319 via an over-molding process. The wire 31 includes an inner conductor 310, an inner insulator 311, an outer/grounding conductor/layer 312 and an outer insulator 313 sequentially coaxially arranged with one another. The connecting section 22 is mechanically and electrically connected to the inner conductor 310 of the corresponding wire 31. The grounding unit 32 includes a pair of first/outer grounding bars 33 and a pair of second/inner grounding bars 34 wherein the second grounding bars 34 are located between the first grounding bars 33. Both the first grounding bars 33 and the second grounding bars 34 are soldered upon the grounding layers 312 of the wires 31. In this embodiment, the transverse bar 319 is integrally formed around the outer conductor 312 while still exposing the grounding layer 312 to allow the grounding layer to be soldered with the first grounding bar 33 and the second grounding bar 34.

The first grounding bar 31 includes a main body 336, an abutment section 330 extending forwardly from two opposite ends of the main body 336, and a cutting section 334. The abutment section 330 is essentially sandwiched between the shell 4 and the housing 1 in the vertical direction and includes an inner/first plate 331, an outer/second plate 333 and an oblique plate 332 therebetween. The shell 4 is forwardly assembled upon the housing 1 with guidance of the oblique section 332. Notably, the wire sub-assembly 3 and the contacts 2 are symmetrically arranged with regard to a horizontal centerline of the connector 100.

A pair of fixing members 36 retain the corresponding cable sub-assembly 3 and the contacts 2. The fixing member 36 is the solidified glue in this embodiment.

A metallic shielding plate 6 is retained in the housing 1 and located between two rows of contacts 2, and includes a horizontal section 60, and a plurality of spring fingers 62 forwardly extending into the mating cavity 9, and a pair of side spring fingers 61 sidewardly extending into the mating cavity 9. In this embodiment, the root of the side spring fingers 61 is welded to the shell 4.

The side wall 7 forms a plurality of passageways 91 to receive the corresponding contacts 2, respectively, wherein the retaining section 23 interferes with the housing 1 in the passageway 91. The side wall 7 further forms an inner step 72 and an outer step 71 at different levers at the longitudinal end thereof. The inner plate 331 is seated upon the inner step 72, and the outer plate 332 is seated upon the outer step 71 and further mechanically and electrically connected to the shell 4 via the embossment 335.

Figure 11:
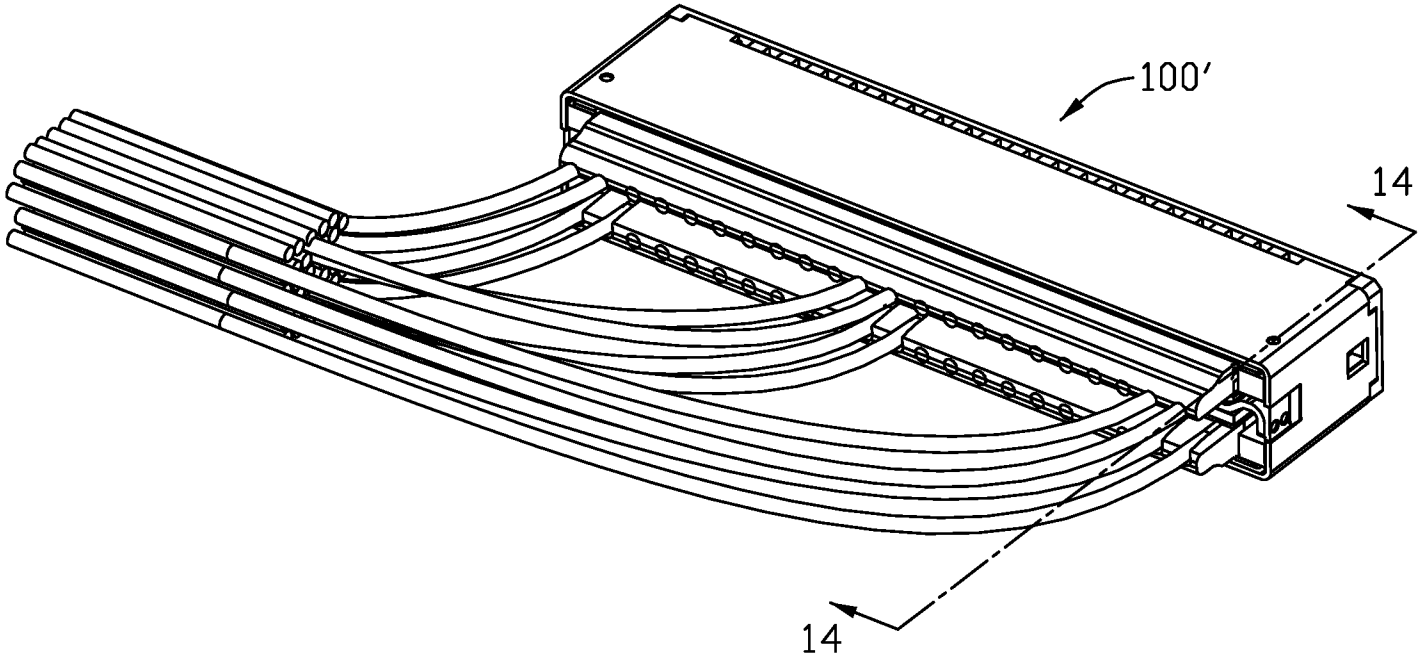
FIG. 11 is a perspective view of the electrical connector according to a second embodiment of the invention.
Figure 12:
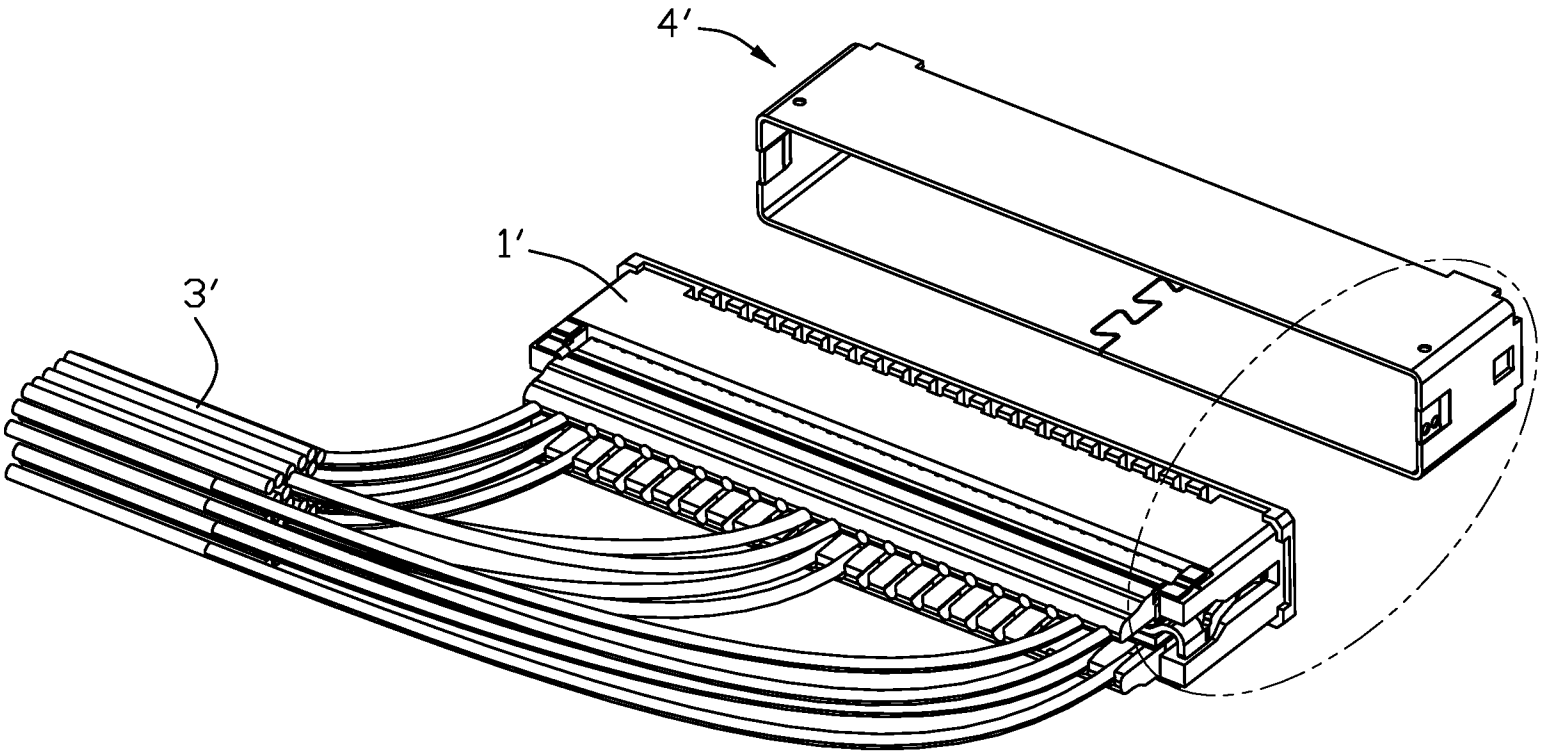
FIG. 12 is an exploded perspective view of the electrical connector of DIG. 11.
Figure 13:
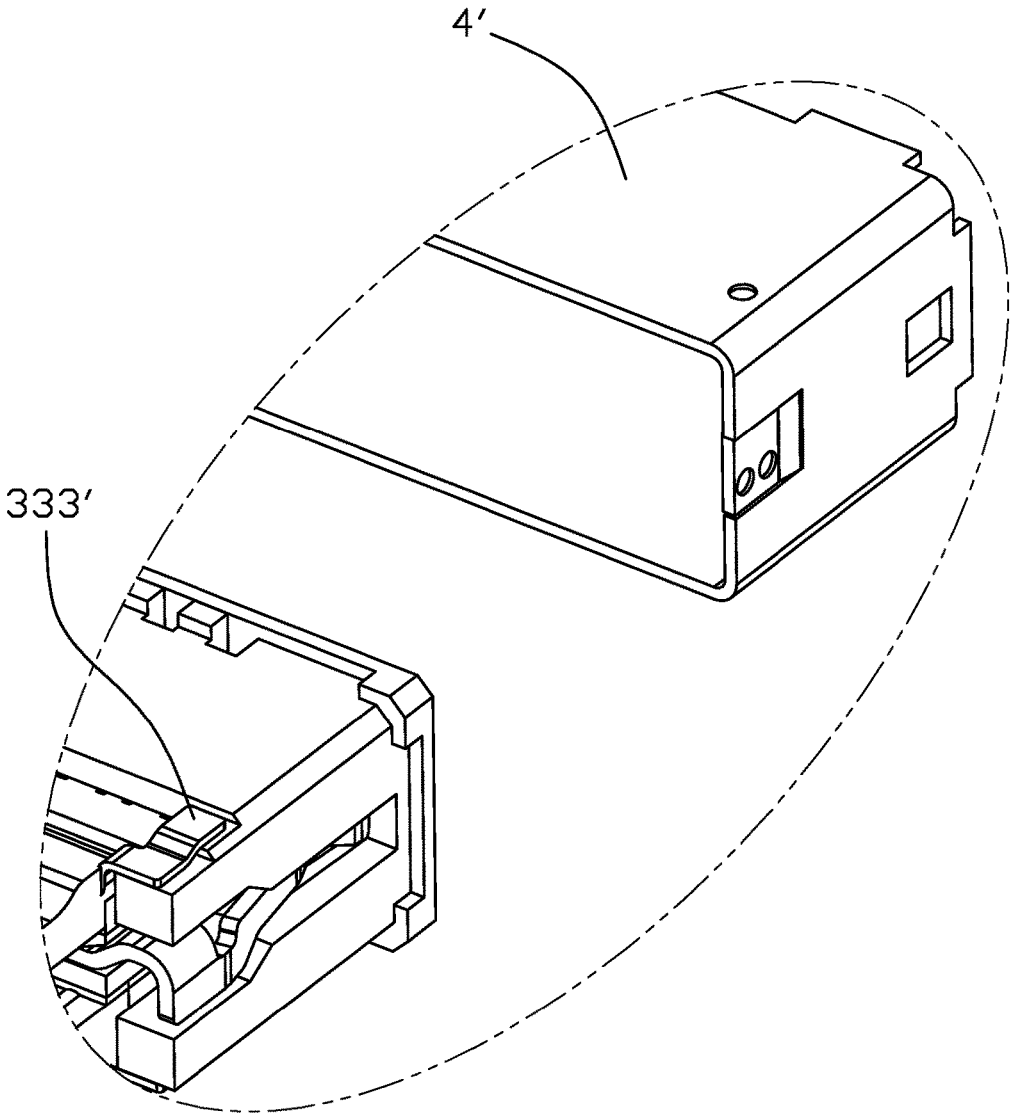
FIG. 13 is an enlarged perspective view of a portion of the electrical connector of FIG. 11 to show how the grounding bar and/or the shielding plate welded to the shielding shell.
Figure 14:
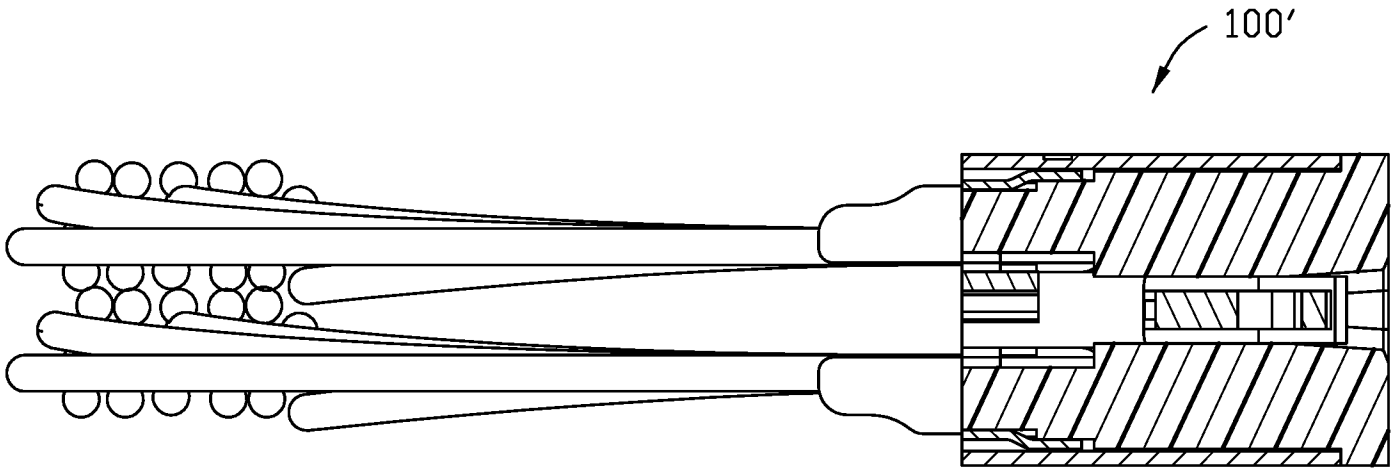
FIG. 14 is a cross-sectional view of the electrical connector of FIG. 11 to show the mechanical and electrical connection between the grounding bar and the shielding shell.

Referring to FIGS. 11-14 of the second embodiment, in the connector 100' the outer plate 333' retained in the housing 1' is not equipped with the embossment but directly soldered to the shell 4'.

Figure 15:
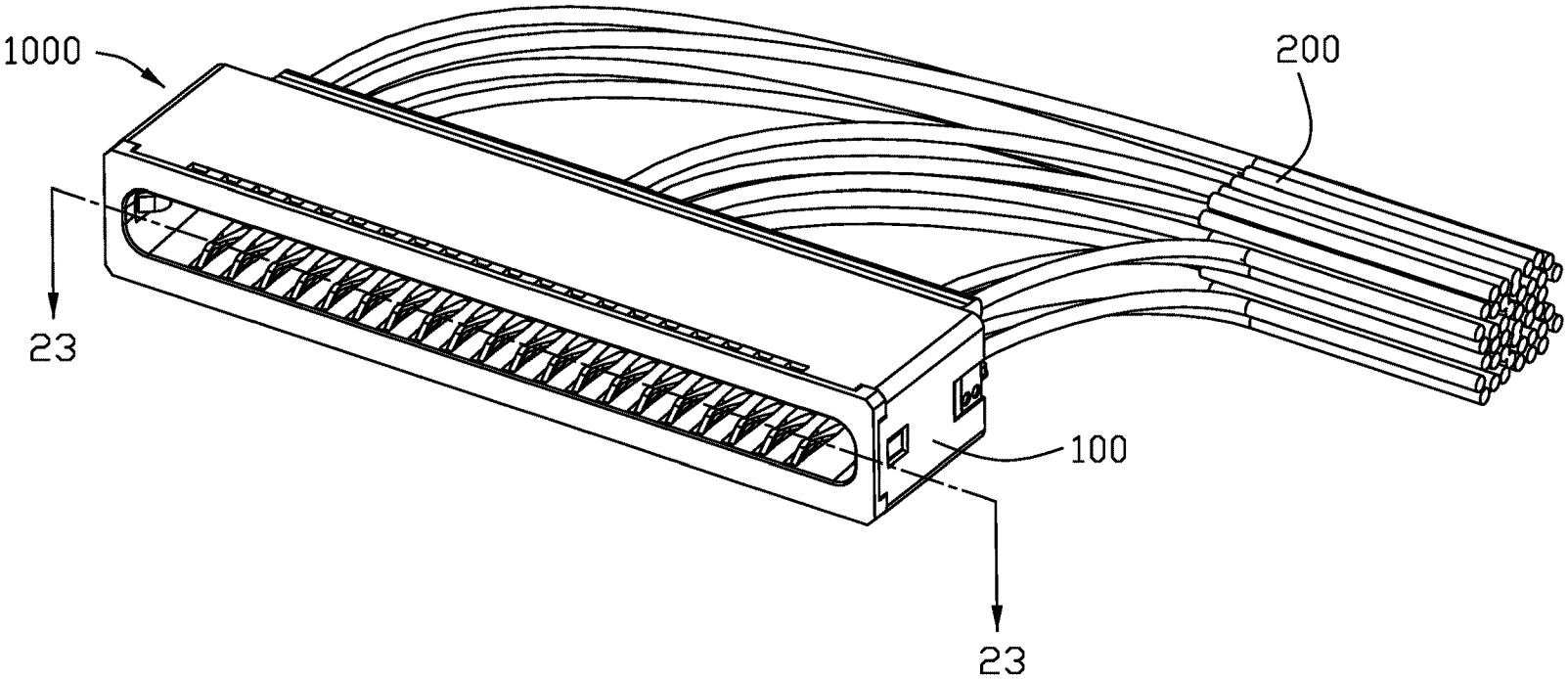
FIG. 15 is a perspective view of an electrical connector according to a third embodiment of the invention.
Figure 16:
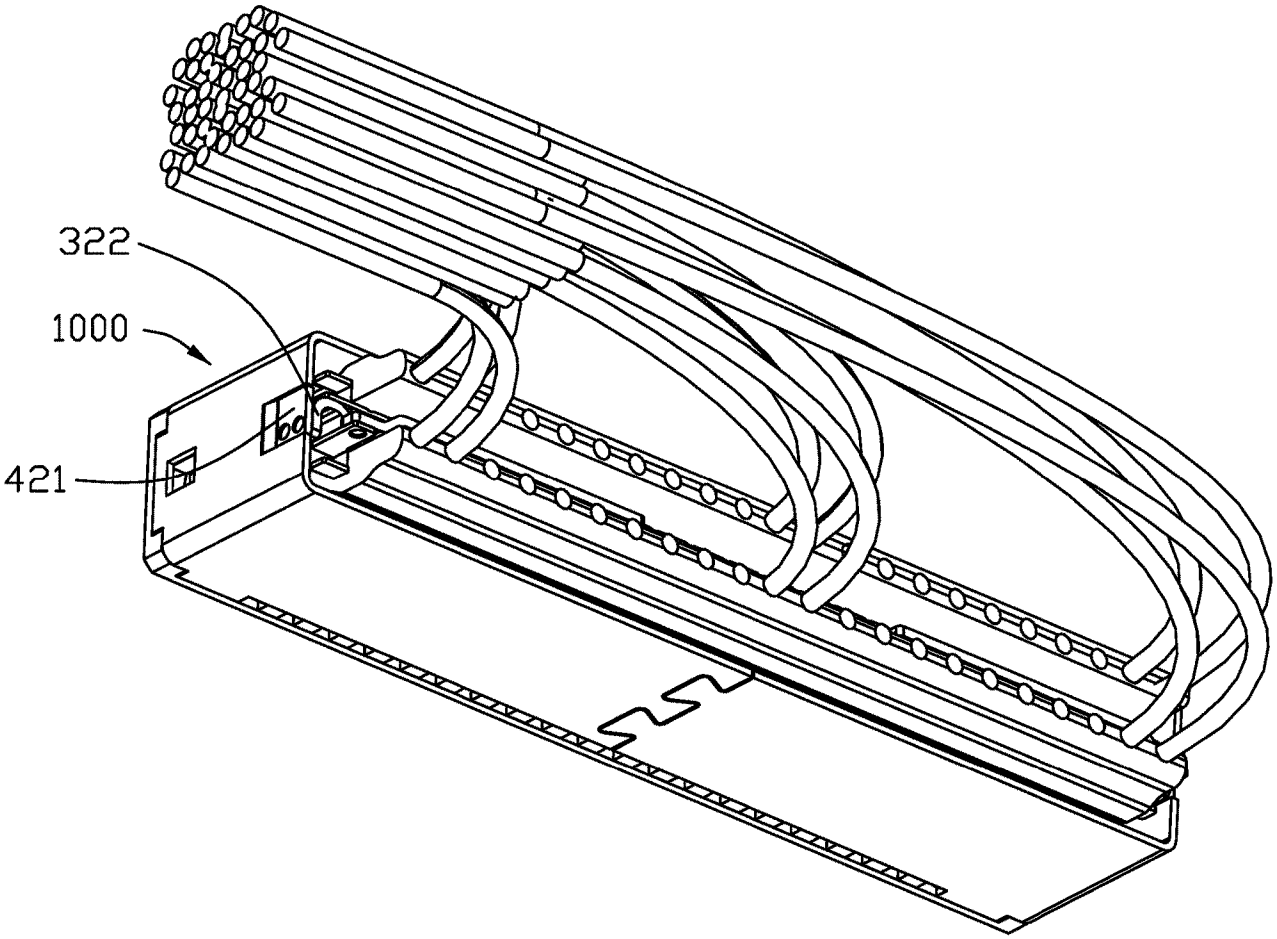
FIG. 16 is another perspective view of the electrical connector of FIG. 15.
Figure 17:
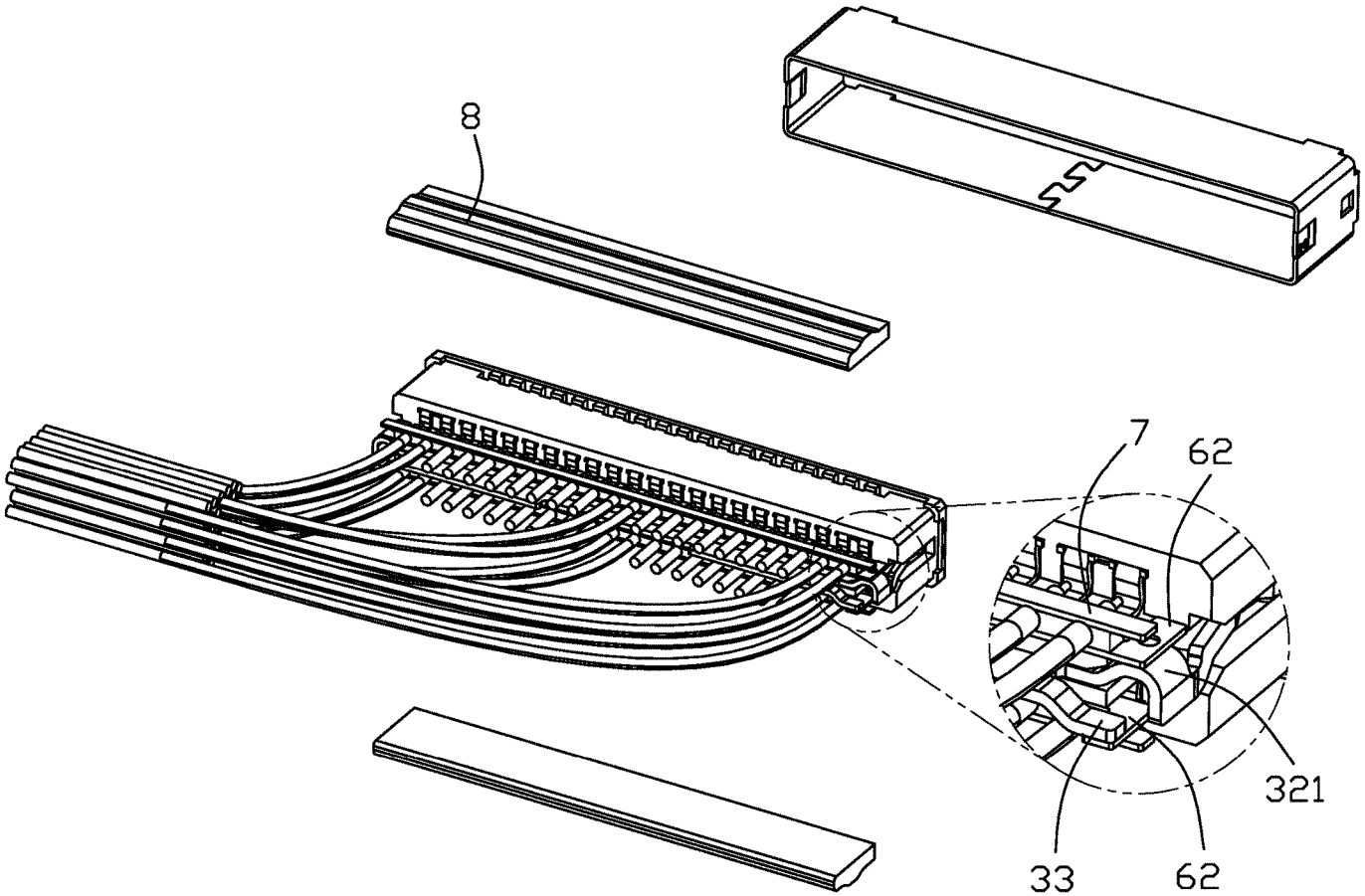
FIG. 17 is an exploded perspective view of the electrical connector of FIG. 15 to show how the shielding plate is mechanically and electrically connected to both the inner grounding bar and the outer grounding bar.
Figure 18:
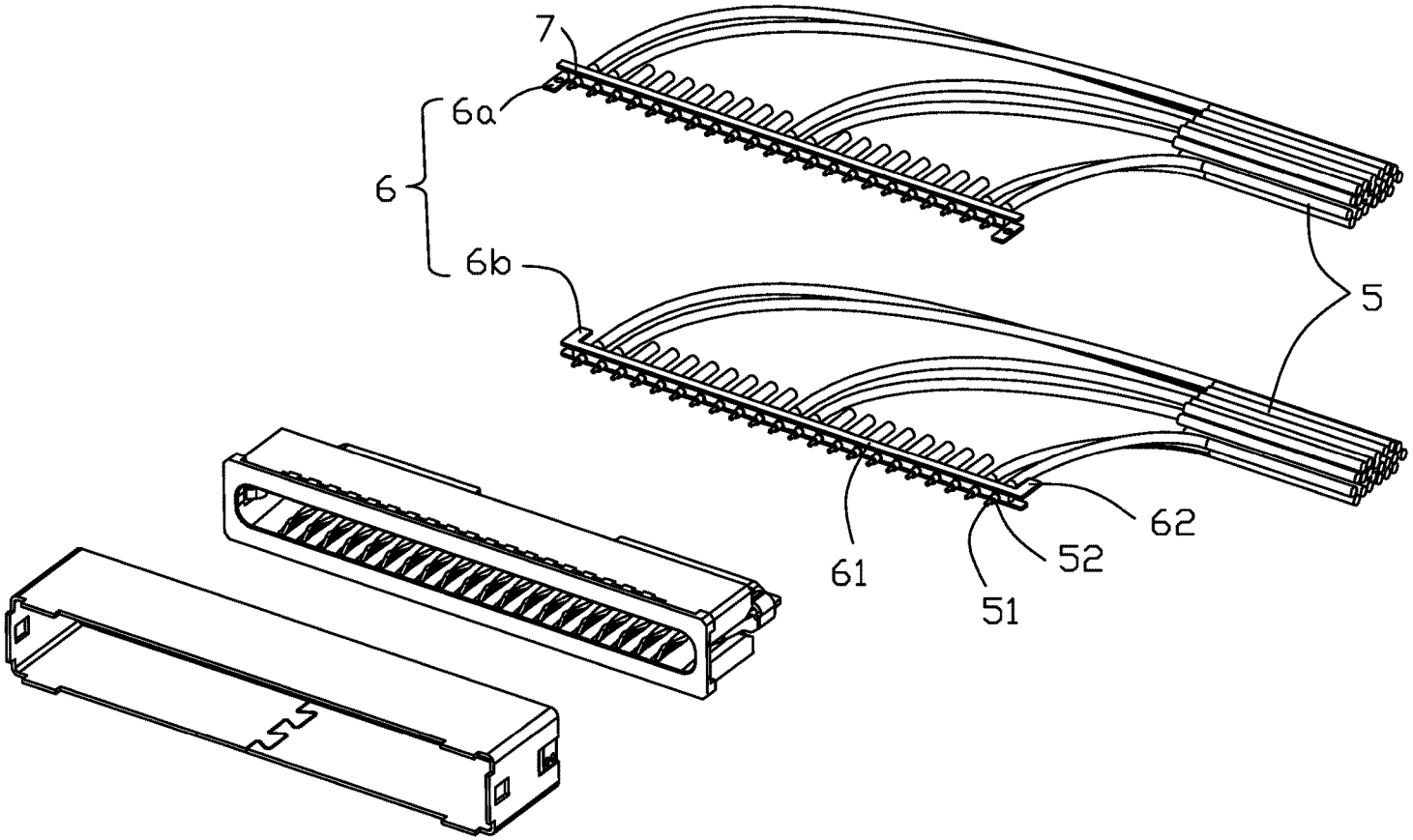
FIG. 18 is another exploded perspective view of the electrical connector of FIG. 17
Figure 19:
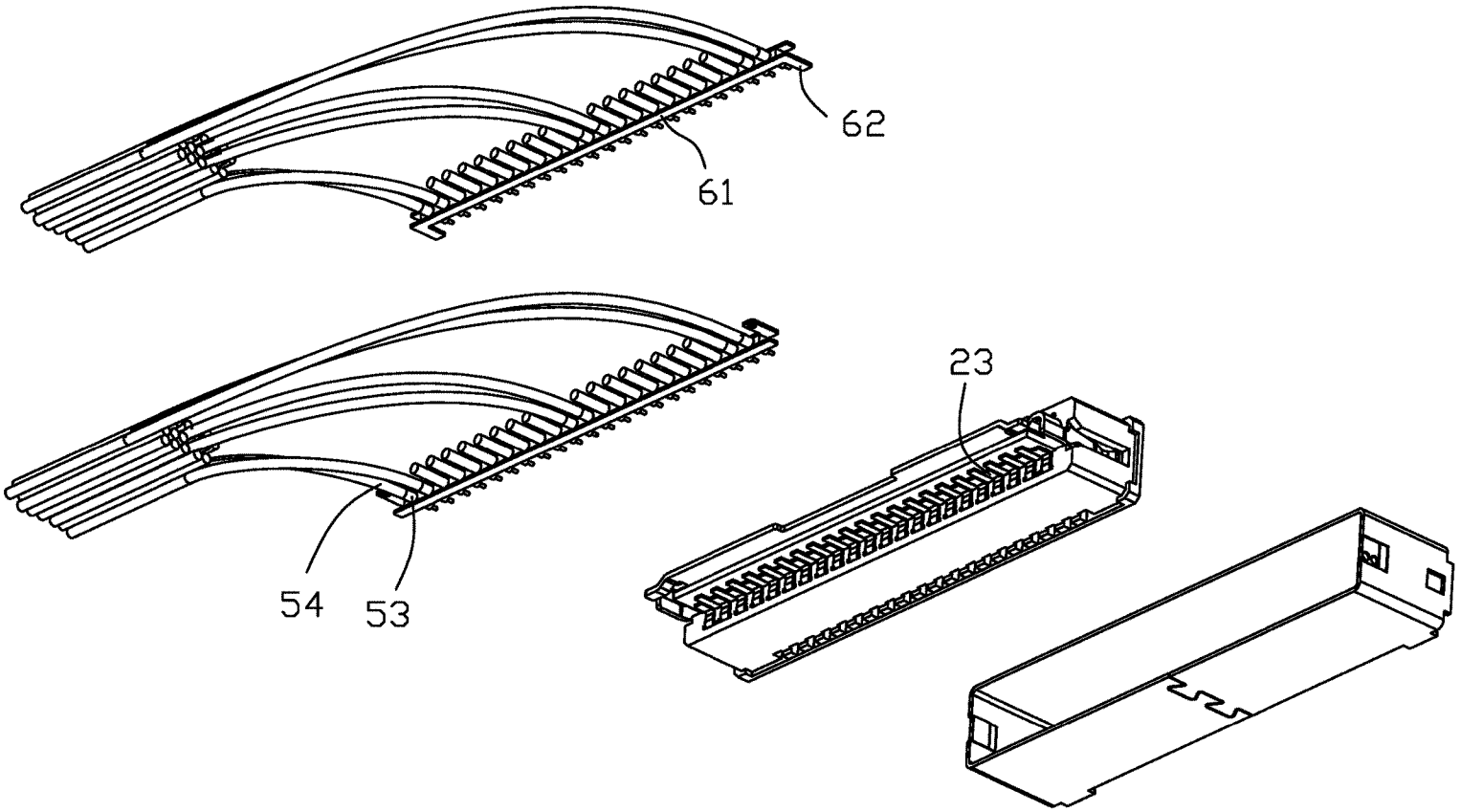
FIG. 19 is another exploded perspective view of the electrical connector of FIG. 18.
Figure 20:
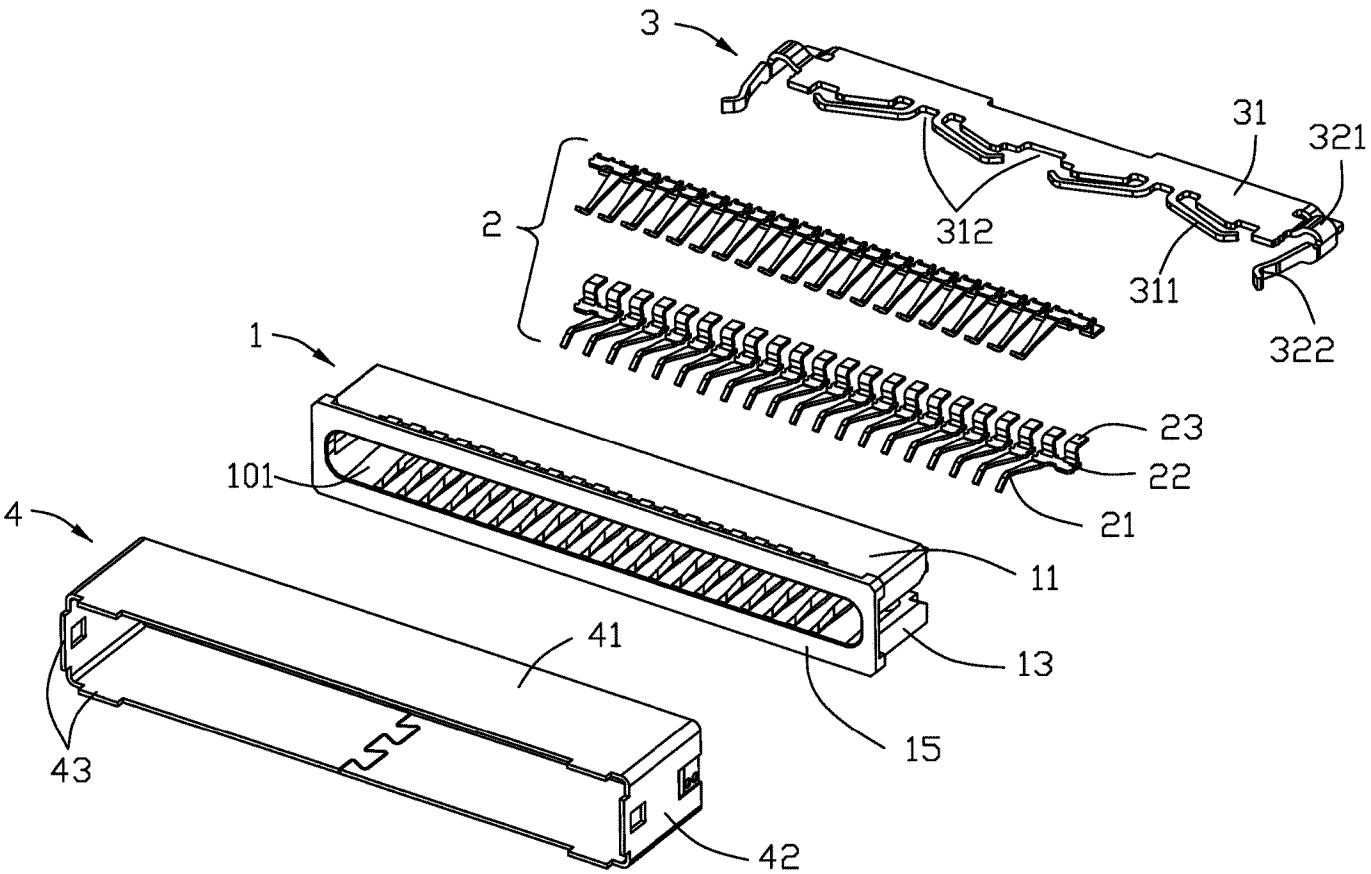
FIG. 20 is a further exploded perspective view of the electrical connector of FIG. 17 without showing the cable sub-assembly thereof.
Figure 21:
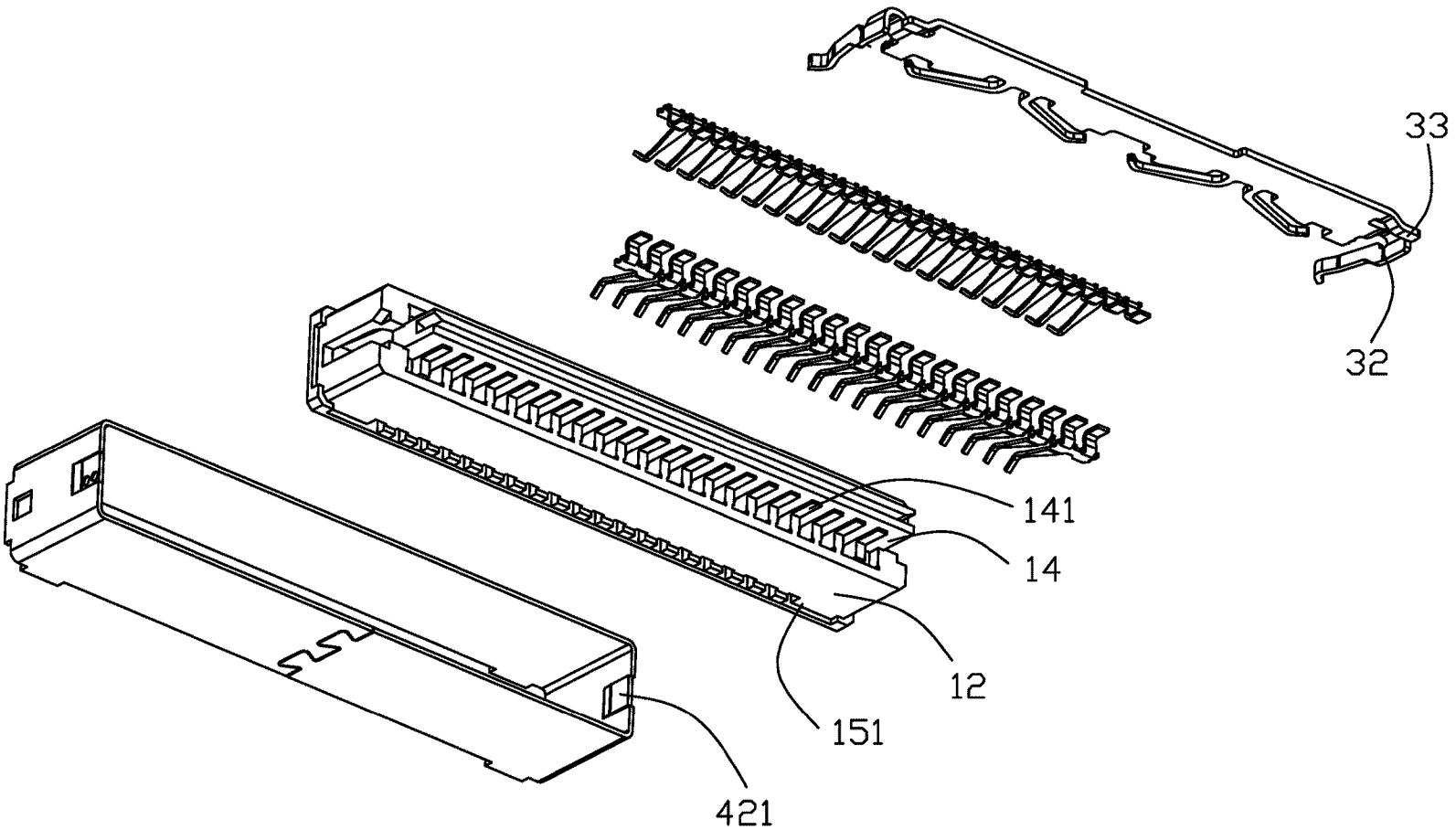
FIG. 21 is another further exploded perspective view of the electrical connector of FIG. 20.
Figure 22:
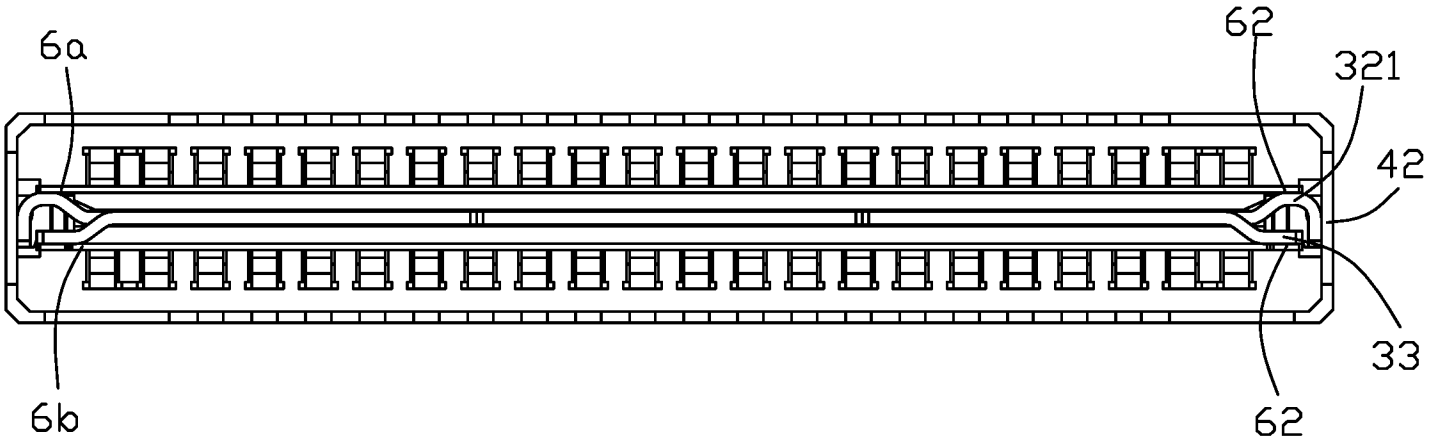
FIG. 22 is an elevational view of the electrical connector of FIG. 15 without showing the cable sub-assembly but to show how the shielding plate is mechanically and electrically connected to both the inner grounding bars.
Figure 23:
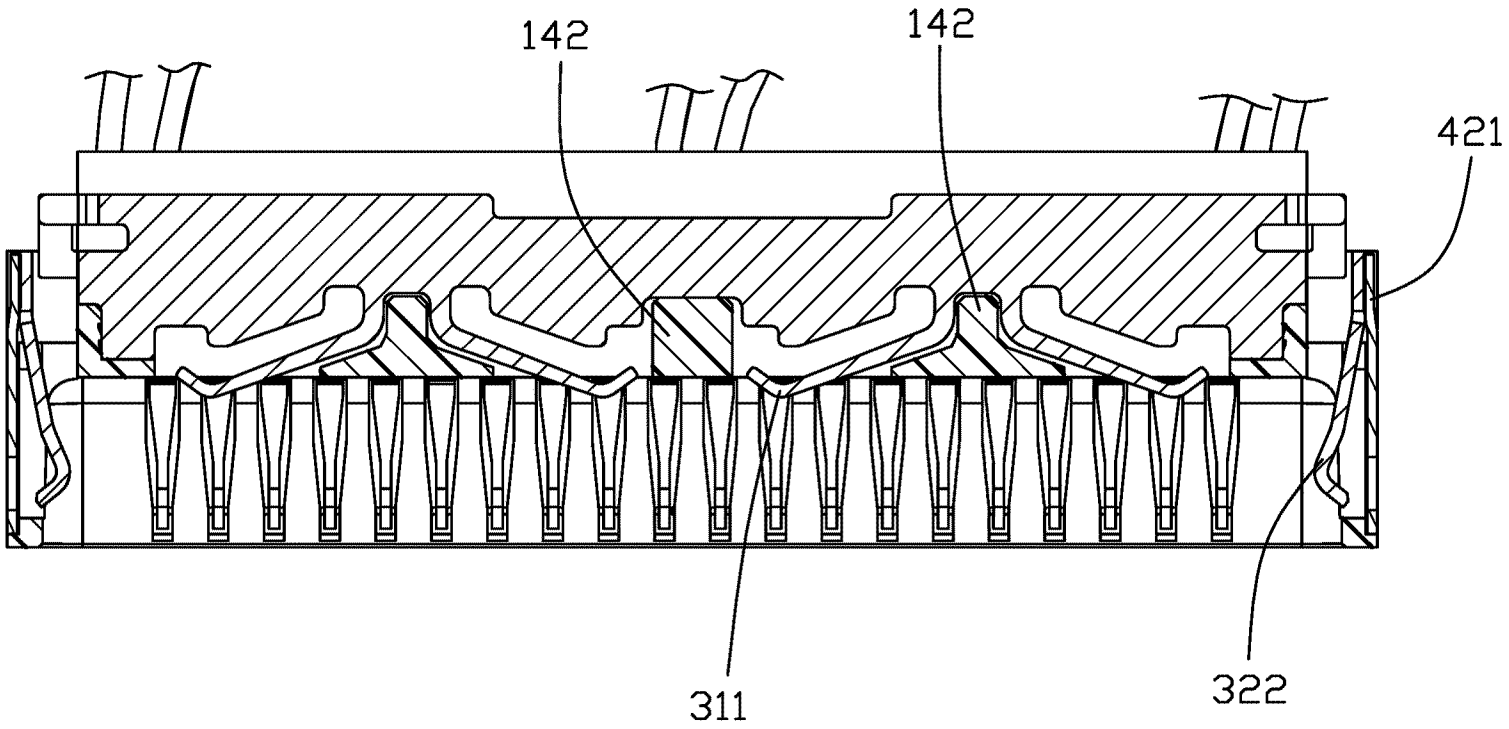
FIG. 23 is a cross-sectional view of the electrical connector of FIG. 15 to show the shielding plate in the mating cavity.

Referring to FIGS. 15-23, the electrical connector assembly 1000 includes an electrical connector 100 and the cable sub-assembly 200 wherein connector 100 includes an insulative housing 1, two rows of contacts 2 retained in the housing 1, a shielding plate 3 retained in the housing 1. A mating cavity 101 is formed in the housing 1 to forwardly communicate with an exterior. The housing 1 includes opposite upper wall 11 and lower wall 12 and two opposite end walls 13 connected therebetween, and a rear wall 14. The upper wall 11 and the lower wall 12 forms a plurality of passageways (not labeled) to retain the corresponding contacts 2.

The contact 2 includes a contacting section 21 extending into the mating cavity 101, a retaining section 22 retained to the housing 1, and a connecting section 23 exposed outside of the housing 1. The rear wall 14 forms a plurality of ribs 141 alternately arranged with the corresponding connecting sections 23 in the longitudinal direction.

The shielding plate 3 includes a plate 31 retained in the rear wall 14, a pair of first/upward extensions 32 and a pair of second/downward extensions 33 at two opposite ends. The first extension 32 includes an abutment section 321 and a side spring finger 322 extending forwardly from the abutment section 321 and sidewardly into the mating cavity 101. The plate 31 further includes a plurality of spring fingers 311 forwardly extending into the mating cavity 101. The plate 31 further forms a retaining slots 312 in which the retaining blocks 142 of the rear wall 14 are received.

The shielding shell 4 includes a pair of horizontal plates 41 and a pair of vertical plates 42. A plurality of protrusions 43 are formed to be received within the corresponding cutouts 151 formed in the flange 15 of the housing 1. The shell 4 further includes resilient tabs 421 to be soldered or welded to the root of the side spring finger 322.

The cable sub-assembly 2 includes a plurality of wires 5, a pair of inner grounding bars 6, pair of outer grounding bars 7 and the fixing members 8. The wire 51 includes an inner conductor 51, an inner insulator 52, an outer conductor/grounding layer 53 and an outer insulator 54 sequentially coaxially arranged with one another. The inner connector 51 is soldered on the connecting section 23.

The inner grounding bar 6 is closer to the shielding plate 3 than the outer grounding bar 7, and includes a main body 61 soldered to the grounding layer 53, and a pair of legs 62 at two opposite ends wherein the legs 62 of one grounding bar 6 extend forwardly while those of the other one extend rearwardly. The legs 62 are mechanically and electrically connected to the shielding plate via soldering or welding. The main body 61 is coplanar with the legs 62. The inner grounding bars 6 includes an upper grounding bar **6*a* contacting the upper row of wires 5 and a lower grounding bar 6*b* contacting the lower row of wires 5. The legs 62 extend forwardly from the main body 61 of the inner grounding bar 6*a* while the legs 62 extend rearwardly from the main body 61 of the inner grounding bar 6*b*. The legs 62 of the inner grounding bar 6*a* are soldered or welded upon the first extensions 32 while the legs 62 of the inner grounding bars 6*b* are soldered or welded upon the second extension 33**.

Similar to the inner grounding bar 6, the outer grounding bar 7 is soldered upon the grounding layer 53. The fixing member 8 is solidified glue to integrally formed with the front region of the wires 5, the inner grounding bars 6, and the outer grounding bars 7.

Compared with the conventional design, the shielding plate 3 includes the first extension 32 and the second extension 33 offset from each other in the front-to-back direction to respectively mechanically and electrically connected to forwardly/rearwardly extending legs of the inner grounding bars **6*a*/6*b* for enhancement of the shielding/grounding of the whole connector. Understandably, instead of the first extension 32 and the second extension 33 formed on the shielding plate 3 extending toward the respective inner grounding bars 6*a* and 6*b*, the extension may be formed on the inner grounding bars 6*a* and 6*b* extending toward the shielding plate 3. On the other hand, similar to the first embodiment, the resilient tab 421 of the shell 4 is mechanically and electrically connected to the abutment section 321, and optionally and optimally via welding, thus achieving all integration among the shell 4, the grounding bars 6 and 7 and the shielding plate 3**.

What is claimed is:

1. An electrical connector assembly comprising:

an insulative housing extending along a longitudinal direction and includes a pair of opposite side walls extending along the longitudinal direction, and a pair of opposite end walls at ends of the side walls to cooperate with the side walls commonly forming a mating cavity forwardly exposed to an exterior in a front-to-back direction perpendicular to the longitudinal direction;

a plurality of passageways formed in each of the side walls;

a metallic shielding shell enclosing the housing;

two rows of contacts disposed in the corresponding passageways, respectively, each of the contacts including a front contacting section exposed in the mating cavity and a rear connecting section exposed outside of the housing;

a metallic shielding plate retained in the housing and between two rows of contacts in a vertical direction perpendicular to both the longitudinal direction an the front-to-back direction;

a cable sub-assembly located behind the housing including:

two rows of wires corresponding to the two rows of contacts, each of said wires including an inner conductor, an inner insulator, an outer conductor and an outer insulator sequentially and coaxially arranged with one another;

a pair of inner grounding bars extending along the longitudinal direction, corresponding to two rows of the wires, and mechanically and electrically connected to the outer conductors of the wires; and a pair of outer grounding bars extending along the longitudinal direction, corresponding to two rows of wires, and mechanically and electrically connected to the outer conductors of the wires opposite to the corresponding inner grounding bars, respectively, in the vertical direction; wherein the shielding plate is located between the pair of inner grounding bars in the vertical direction, and between the pair of outer grounding bars in the vertical direction as well.

2. The electrical connector assembly as claimed in claim 1, wherein the shielding plate includes a pair of extensions at two opposite longitudinal ends respectively mechanically and electrically connected to the shielding shell sidewardly.

3. The electrical connector assembly as claimed in claim 2, wherein each of said extension forms a side spring finger extending into the mating cavity sidewardly.

4. The electrical connector assembly as claimed in claim 1, wherein each of the outer grounding bars is mechanically and electrically connected to the shielding shell in the vertical direction.

5. The electrical connector assembly as claimed in claim 4, wherein each outer grounding bar forms a forward extension to contact the shielding shell.

6. The electrical connector assembly as claimed in claim 5, wherein said extension is sandwiched between the shielding shell and the housing in the vertical direction.

7. The electrical connector assembly as claimed in claim 1, wherein each of the inner grounding bars mechanically and electrically connected to the shielding plate at two opposite ends thereof.

8. The electrical connector assembly as claimed in claim 7, wherein said shielding plate forms opposite upward and downward extensions respectively connecting to the pair of inner grounding bars in the vertical direction.

9. The electrical connector assembly as claimed in claim 8, wherein the upward extension and the downward extension are offset from each other in the front-to-back direction.

10. The electrical connector assembly as claimed in claim 8, wherein one of the inner grounding bars forms forwardly extending legs at said two opposite ends to contact the upward extensions while the other of said inner grounding bars forms rearwardly extending legs at said two opposite ends to contact the downward extensions.

11. The electrical connector assembly as claimed in claim 1, wherein the inner grounding bars mechanically and electrically connect to the shielding plate while the outer grounding bars mechanically and electrically connect to the shield shell.

12. An electrical connector assembly comprising:

an insulative housing extending along a longitudinal direction and includes a pair of opposite side walls extending along the longitudinal direction, and a pair of opposite end walls at ends of the side walls to cooperate with the side walls commonly forming a mating cavity forwardly exposed to an exterior in a front-to-back direction perpendicular to the longitudinal direction;

a plurality of passageways formed in each of the side walls;

two rows of contacts disposed in the corresponding passageways, respectively, each of the contacts including a front contacting section exposed in the mating cavity and a rear connecting section exposed outside of the housing;

a metallic shielding plate retained in the housing and between two rows of contacts in a vertical direction perpendicular to both the longitudinal direction an the front-to-back direction;

a metallic shielding shell enclosing the housing;

a cable sub-assembly located behind the housing including:

two rows of wires corresponding to the two rows of contacts, each of said wires including an inner conductor, an inner insulator, an outer conductor and an outer insulator sequentially and coaxially arranged with one another; and a pair of outer grounding bars extending along the longitudinal direction, corresponding to two rows of wires and mechanically, and electrically connected to opposite outsides of the outer conductors of the wires in the vertical direction; wherein the shielding plate is located between the pair of outer grounding bars in the vertical direction; wherein each of said outer grounding bars includes forwardly extending legs at two opposite ends in the longitudinal direction, to mechanically and electrically connect to the shielding shell.

13. The electrical connector assembly as claimed in claim 12, wherein each of said forwardly extending legs includes an oblique plate between an inner plate and an outer plate outwardly touching the shielding shell in the vertical direction.

14. The electrical connector assembly as claimed in claim 13, wherein each of said outer grounding bars is located within the shielding shell.

15. The electrical connector assembly as claimed in claim 13, wherein the side wall of the housing includes an inner step and an outer step at either end, said inner plate seated upon the inner step and said outer plate seated upon the outer step.

16. An electrical connector assembly comprising:

an insulative housing extending along a longitudinal direction and includes a pair of opposite side walls extending along the longitudinal direction, and a pair of opposite end walls at ends of the side walls to cooperate with the side walls commonly forming a mating cavity forwardly exposed to an exterior in a front-to-back direction perpendicular to the longitudinal direction;

a plurality of passageways formed in each of the side walls;

a metallic shielding shell enclosing the housing;

two rows of contacts disposed in the corresponding passageways, respectively, each of the contacts including a front contacting section exposed in the mating cavity and a rear connecting section exposed outside of the housing;

a metallic shielding plate retained in the housing and between two rows of contacts in a vertical direction perpendicular to both the longitudinal direction an the front-to-back direction;

a cable sub-assembly located behind the housing including:

two rows of wires corresponding to the two rows of contacts, each of said wires including an inner conductor, an inner insulator, an outer conductor and an outer insulator sequentially and coaxially arranged with one another; and a pair of inner grounding bars extending along the longitudinal direction, corresponding to two rows of the wires, and mechanically and electrically connected to opposite inner sides of the outer conductors of the wires; wherein the shielding plate is located between the pair of inner grounding bars in the vertical direction; wherein the shielding plate forms a pair of upward extensions and a pair of downward extensions at two opposite ends in said longitudinal direction to mechanically and electrically connect two opposite ends of both said pair of inner grounding bars.

17. The electrical connector assembly as claimed in claim 16, wherein said pair of inner grounding bars forms a pair of forwardly extending legs and a pair of rearwardly extending legs at said opposite ends to mechanically and electrically connect to said pair of upward extensions and said pair of downward extensions.

18. The electrical connector assembly as claimed in claim 17, wherein said pair of upward extensions are formed in front of said pair of downward extensions in the front-to-back direction.

19. The electrical connector assembly as claimed in claim 18, wherein said pair of forwardly extending legs are commonly formed on one of the pair of inner grounding bars to mechanically and electrically connect to the pair of upward extension, and said pair of rearwardly extending legs are commonly formed on the other of the pair of inner grounding bars to mechanically and electrically connect to the pair of downward extensions.

20. The electrical connector assembly as claimed in claim 16, wherein a pair of side spring fingers further extend forwardly from the pair of corresponding upward extensions, respectively, and into the mating cavity opposite to each other in the longitudinal direction.

* * * * *